US008916800B2

(12) United States Patent
Cheng et al.

(10) Patent No.: US 8,916,800 B2
(45) Date of Patent: Dec. 23, 2014

(54) GLOW PLUG

(75) Inventors: Yue Cheng, Shenyang (CN); Bernd Last, Reutlingen (DE); Jochen Hammer, Stuttgart (DE); Harald Reustlen, Sachsenheim (DE); Andreas Ruthmann, Eberdingen (DE)

(73) Assignee: BorgWarner BERU Systems GmbH, Ludwigsburg (DE)

( * ) Notice: Subject to any disclaimer, the term of this patent is extended or adjusted under 35 U.S.C. 154(b) by 95 days.

(21) Appl. No.: 13/325,462

(22) Filed: Dec. 14, 2011
(Under 37 CFR 1.47)

(65) Prior Publication Data

US 2012/0187102 A1 Jul. 26, 2012

(30) Foreign Application Priority Data

Dec. 18, 2010 (DE) ..... 10 2010 055 119

(51) Int. Cl.
*F23Q 7/22* (2006.01)
*F23Q 7/00* (2006.01)

(52) U.S. Cl.
CPC ..... *F23Q 7/001* (2013.01)
USPC ..... 219/267

(58) Field of Classification Search
CPC ... F23Q 7/001; H05B 3/141; H05B 2203/027
USPC ..... 219/267, 260, 270
See application file for complete search history.

(56) References Cited

U.S. PATENT DOCUMENTS

| | | | | |
|---|---|---|---|---|
| 8,003,917 | B2 | 8/2011 | Kern et al. | |
| 2002/0153365 | A1 | 10/2002 | Taniguchi et al. | |
| 2002/0185485 | A1 * | 12/2002 | Radmacher | 219/270 |
| 2011/0215080 | A1 | 9/2011 | Hain et al. | |

FOREIGN PATENT DOCUMENTS

EP 1 239 222 A2 9/2002

* cited by examiner

*Primary Examiner* — Dana Ross
*Assistant Examiner* — Lindsey C Teaters
(74) *Attorney, Agent, or Firm* — Hackler Daghighian & Martino

(57) ABSTRACT

A glow plug includes a ceramic glow pencil, a protective sleeve from which the glow pencil protrudes, and a housing from which the protective sleeve protrudes. The protective sleeve is fastened to the glow pencil via a holding element which is disposed outside of the housing and is soldered to the glow pencil. The ceramic glow pencil includes a substantially cylindrical inner conductor disposed along a length of a distal end of the ceramic glow pencil, an insulating layer disposed over the inner conductor, and an outer conductive layer disposed over the insulating layer, wherein the outer conductive layer is connected to the inner conductor at the distal end of the ceramic glow pencil.

20 Claims, 2 Drawing Sheets

GLOW PLUG

The ceramic glow pencils of such glow plugs are fragile. Therefore, there is a risk that the glow pencil will break during manufacture or during subsequent use in an engine. Fragments of a glow pencil that drop into the combustion chamber of an engine can cause serious damage. A protective sleeve enclosing the glow pencil can protect the glow pencil from damage and reduce the risk of breakage. In addition, if breakage should occur, the protective sleeve can hold the glow plug and prevent pieces of the glow pencil that have broken off from dropping into the combustion chamber of the engine.

The problem addressed by the invention is that of demonstrating a way to further reduce the risk of breakage of the glow pencil.

SUMMARY OF THE INVENTION

In a glow plug according to the invention, the protective sleeve is fastened to the glow pencil using a holding element which is disposed outside of the housing and is soldered to the glow pencil. The glow pencil extends through the holding element. The holding element can be in the form of a ring or a sleeve. Since the holding element has a shorter length than the protective sleeve, it can be soldered to the glow pencil more easily than the protective sleeve. In addition, the glow plug is stressed only minimally by being soldered to the holding element, thereby reducing the risk that the seeds of cracks will form. The verb "solder" encompasses silver soldering, brazing and any other method of joining by melting and flowing a filler metal into the joint.

In an advantageous refinement of the invention, the holding element electrically contacts an outer conductive layer of the glow plug. In this manner, a ground connection can be advantageously attained, namely by connecting the outer conductor to the housing in an electrically conductive manner via the holding element and the protective sleeve.

In a further advantageous refinement of the invention, the glow pencil has, on the end thereof disposed in the housing, a tapered section which plugs into a connecting element. In a glow pencil which has an inner conductor enclosed by an insulator layer, the inner conductor can be connected to the inner pole of the glow plug in this manner, e.g. by soldering the tapered section to the connecting element.

Preferably, the glow plug has a cylindrical main section which adjoins a connecting section which is preferably tapered, and a glow tip which is thinner than the main section. The protective sleeve preferably encloses the main section. Particularly preferably, the main section extends out of the protective sleeve on the end thereof facing away from the housing, and therefore the protective sleeve terminates in front of the glow tip. In this manner, unwanted heat dissipation to the housing can be reduced.

It is also preferable that the holding element terminates at a distance from the glow tip. In this manner the holding element can be soldered to a cylindrical section of the glow pencil and reliably enter into a dense solder connection. The cylindrical section preferably extends out of the holding element at both ends. This is not absolutely necessary, however, since, for example, the outer conductor contacted to the solder connection may have a different outer diameter than a glow pencil section adjacent thereto, in which the outer conductor is no longer present and, instead, an insulator layer forms the outermost layer of the glow pencil.

It is furthermore preferable that the cylindrical main section extends out of the protective sleeve via the end thereof facing away from the glow tip. In this manner the connection of the glow pencil to an inner pole of the glow plug can be achieved more easily since the distance to the protective sleeve at ground potential is greater.

In a further advantageous refinement of the invention, the holding element is a cylindrical sleeve. A sleeve having a cylindrical inner surface and a cylindrical outer surface can be manufactured at low cost and easily soldered to a cylindrical section of a glow pencil.

In a further advantageous refinement of the invention, the holding element extends the protective sleeve. Although it is possible for the protective sleeve to enclose the holding element entirely, this results in an unnecessarily large outer diameter of the protective element.

BRIEF DESCRIPTION OF THE DRAWINGS

Further details and advantages of the invention are explained using an embodiment, with reference to the attached drawings.

DETAILED DESCRIPTION

Figure 1:
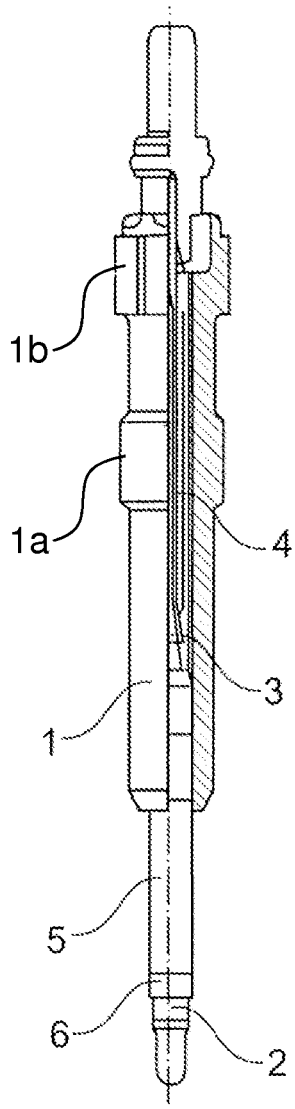
FIG. 1 shows an embodiment of a glow plug according to the invention, in a partially exposed view.

The glow plug shown in FIG. 1 has a housing 1, out of which a ceramic glow pencil 2 protrudes. In the embodiment shown, the housing 1 has an external thread 1*a* and a hexagon 1*b* for screwing into an engine. Glow plugs can be mounted on an engine in another manner, however, and therefore fastening means other than the external thread 1*a* and the hexagon 1*b* can be provided.

The glow pencil 2 has, on the end thereof disposed in the housing 1, a tapered section which inserts into a connecting element 3, via which the glow pencil 2 is connected to an inner pole 4 of the glow plug. On the other end thereof, the glow pencil 2 has a glow tip which is preferably in the form of a section having a reduced diameter. Between these two end sections, the glow pencil is enclosed by a cylindrical protective sleeve 5. In the embodiment shown, the protective sleeve 5 encloses only the cylindrical section of the glow pencil 2. The cylindrical section of the glow pencil 2 protrudes at both ends from the protective sleeve.

A holding element 6 disposed outside of the housing 1, which is soldered to the glow pencil 2, adjoins the protective sleeve 5. In the embodiment shown, the holding element 6 is in the form of a ring or a cylindrical sleeve, and is bonded to the protective sleeve 5, preferably by welding. The protective sleeve 5 is connected to the glow pencil 2 via the holding element 6 which is shorter than the protective sleeve 5.

Figure 2:
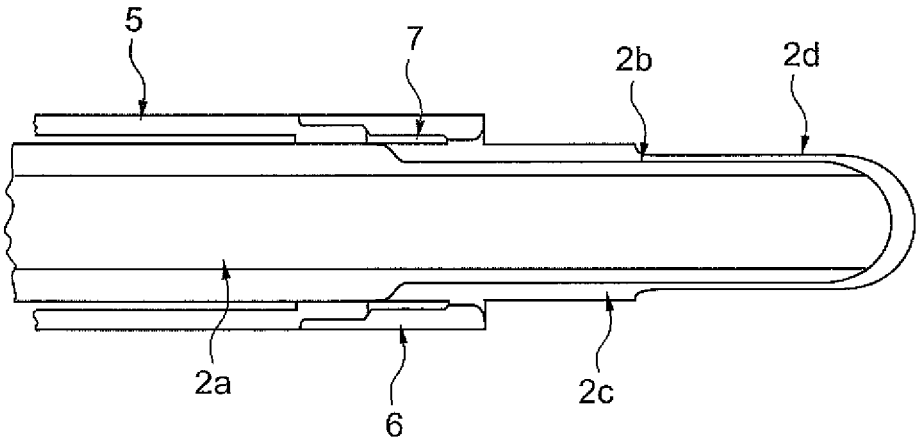
FIG. 2 shows a schematic depiction of the glow pencil with holding element and protective sleeve.

The holding element 6, the protective sleeve 5 and a portion of the glow pencil 2 are depicted schematically in a sectional view in FIG. 2. The ceramic glow pencil 2 has a ceramic inner conductor 2*a* which is surrounded by a ceramic insulating layer 2*b*. In a front region of the glow pencil, the thickness of the insulating layer 2*b* is reduced, and the insulating layer 2*b* is covered by an outer conductive layer 2*c*. This outer conductive layer 2*c* has a reduced thickness in the region of the glow tip, thereby forming a heating conductor layer 2*d*. The electrical resistance is therefore increased in the region of the glow tip, and therefore thermal energy is released there during operation.

As shown in FIG. 2, the outer conductive layer 2*c* of the glow pencil 2 is electrically contacted by the holding element 6. However, the holding element 6 does not enclose the thinner section of the glow pencil that forms the glow tip, but rather terminates at a distance from the glow tip and encloses a thicker cylindrical section of the glow pencil. Preferably, the main section of the glow pencil enclosed by the holding element 6 has the same thickness as the section of the glow pencil enclosed by the protective sleeve 5.

The outer conductor 2*c* of the glow pencil can be connected to ground via the holding element 6, the protective sleeve 5 and the housing 1. In the embodiment shown, a cylindrical solder layer 7 connects a cylindrical inner surface of the holding element 6 to a cylindrical outer surface of the glow pencil 2.

In the embodiment shown, the protective sleeve 5 is extended by the holding element 6. It is also possible, however, for the protective sleeve 5 to enclose the holding element 6 completely. For a mechanically reliable connection it is advantageous when the protective sleeve 5 and the holding element 6 overlap. For example, the holding element 6 can have a stepped or beveled edge on the end facing the protective sleeve 5, which overlaps with an edge of the protective sleeve 5 having a matching shape.

As shown in FIG. 2, an air-filled gap is present between the protective sleeve 5 and the glow pencil 2. It is thereby ensured that the glow pencil 2 is not mechanically stressed when the protective sleeve 5 is slipped on. The risk of crack tips forming during assembly of the glow plug, which eventually make it easier for the glow pencil to break, can be reduced in this manner. This air-filled gap is cylindrical as it is present between a cylindrical section of the glow pencil 2 and the protective sleeve 5.

REFERENCE NUMERALS

1 Housing
1*a* Thread
1*b* Hexagon
2 Glow pencil
2*a* Inner conductor
2*b* Insulating layer
2*c* Outer conductive layer
3 Connecting element
4 Inner pole
5 Protective sleeve
6 Holding element
7 Solder layer

What is claimed is:

1. A glow plug comprising:
a ceramic glow pencil;
a protective sleeve from which the ceramic glow pencil protrudes;
a housing from which the protective sleeve protrudes; and
a holding element connected to a distal end of the protective sleeve, said holding element being disposed completely outside of the housing and outside of the protective sleeve, where the holding element is directly connected to the ceramic glow pencil by a solder, and where said holding element is substantially sleeve-shaped or ring-shaped.

2. The glow plug according to claim 1, wherein the holding element electrically contacts an outer conductive layer of the glow pencil.

3. The glow plug according to claim 1, wherein the holding element encloses a cylindrical section of the glow pencil, wherein the cylindrical section protrudes from the holding element on the side facing away from the housing.

4. The glow plug according to claim 1, wherein the protective sleeve is bonded to the holding element.

5. The glow plug according to claim 1, wherein the protective sleeve is welded to the holding element.

6. The glow plug according to claim 1, wherein the protective sleeve is cylindrical.

7. The glow plug according to claim 1, wherein the ceramic glow pencil protrudes from the protective sleeve on the end thereof facing away from a glow tip.

8. The glow plug according to claim 1, wherein the ceramic glow pencil has a cylindrical section protruding from the protective sleeve on an end thereof facing away from a glow tip.

9. The glow plug according to claim 1, wherein a gap is present between the protective sleeve and the glow pencil.

10. The glow plug according to claim 9, wherein the gap is cylindrical.

11. The glow plug according to claim 1, wherein the holding element and the protective sleeve overlap in a connecting section.

12. The glow plug according to claim 1, wherein the holding element is shorter than the protective sleeve.

13. A glow plug comprising:
a ceramic glow pencil comprising a substantially cylindrical inner conductor disposed along a length of the ceramic glow pencil, an insulating layer disposed over the inner conductor, and an outer conductive layer disposed over the insulating layer, wherein the outer conductive layer is connected to the inner conductor at a distal end of the ceramic glow pencil;
a conductive holding element electrically coupled to the outer conductive layer by a solder, where the conductive holding element is disposed around an end of the outer conductive layer opposite the distal end of the ceramic glow pencil;
a protective sleeve electrically coupled to the holding element, the protective sleeve disposed around the ceramic glow pencil extending away from the distal end of the ceramic glow pencil, and wherein the conductive holding element and the protective sleeve enclose different sections of the ceramic glow pencil; and
a housing, wherein the protective sleeve protrudes from the housing.

14. The glow plug according to claim 13, wherein the insulating layer comprises a thick insulating section and a thin insulating section, the thin insulating section being disposed at the distal end of the ceramic glow pencil.

15. The glow plug according to claim 14, wherein the outer conductive layer is only disposed over the thin insulating section of the insulating layer.

16. The glow plug according to claim 15, wherein the outer conductive layer comprises a thick conductive section connected to a thin conductive section.

17. The glow plug according to claim 16, wherein the thin conductive section of the outer conductive layer is disposed at the distal end of the ceramic glow pencil.

18. The glow plug according to claim 17, wherein the protective sleeve is not disposed around the outer conductive layer.

19. The glow plug according to claim 13, wherein a cylindrical-shaped gap is formed between the protective sleeve and the insulating layer.

20. A glow plug comprising:
a ceramic glow pencil;
a protective sleeve from which the ceramic glow pencil protrudes;
a housing from which the protective sleeve protrudes;
a holding element connected to a distal end of the protective sleeve, said holding element being disposed completely outside of the housing, where the holding element is directly connected to the ceramic glow pencil by a solder layer, and where said holding element is substantially sleeve-shaped or ring-shaped; and a cylindrical gap disposed between a portion of the protective sleeve and a portion of the glow pencil.

* * * * *